United States Patent [19]

Rodda

[11] 4,356,781

[45] Nov. 2, 1982

[54] THREAD HANDLING ARRANGEMENT FOR SEWING MACHINES

[75] Inventor: Donald Rodda, Butler, N.J.

[73] Assignee: The Singer Company, Stamford, Conn.

[21] Appl. No.: 224,246

[22] Filed: Jan. 12, 1981

[51] Int. Cl.[3] ..... D05B 1/12; D05B 47/00; D05B 49/02

[52] U.S. Cl. ..... 112/184; 142/245; 142/255

[58] Field of Search ..... 112/181, 184, 241, 242, 112/245, 247, 249, 250, 255

[56] References Cited

U.S. PATENT DOCUMENTS

| | | | |
|---|---|---|---|
| 171,558 | 12/1875 | Gibbs | 112/254 |
| 175,602 | 4/1876 | Follett | 112/249 |
| 276,113 | 4/1883 | Wilcox et al. | 112/241 |
| 314,635 | 3/1885 | Whitney | 112/255 X |
| 331,026 | 11/1885 | Bigelow | 112/241 X |
| 908,434 | 12/1908 | Woodward | 112/242 |
| 3,561,385 | 2/1971 | Johnson | 112/247 |
| 3,587,495 | 6/1971 | Johnson | 112/184 |
| 4,263,859 | 4/1981 | Johnson | 112/184 |

FOREIGN PATENT DOCUMENTS 571607 1/1958 Italy .

*Primary Examiner*—W. Carter Reynolds
*Attorney, Agent, or Firm*—William V. Ebs; Robert E. Smith; Edward L. Bell

[57] ABSTRACT

A thread handling system for a sewing machine is provided with elongate thread holding members formed for frictional contact of both members with thread during movement of the thread in the holder free of a takeup, and both formed and placed to cause thread in the thread holder to be pulled by the takeup away from one of the members and frictional drag on the thread holder reduced during movement of the takeup in the stitch setting direction.

8 Claims, 15 Drawing Figures

Fig. 2.
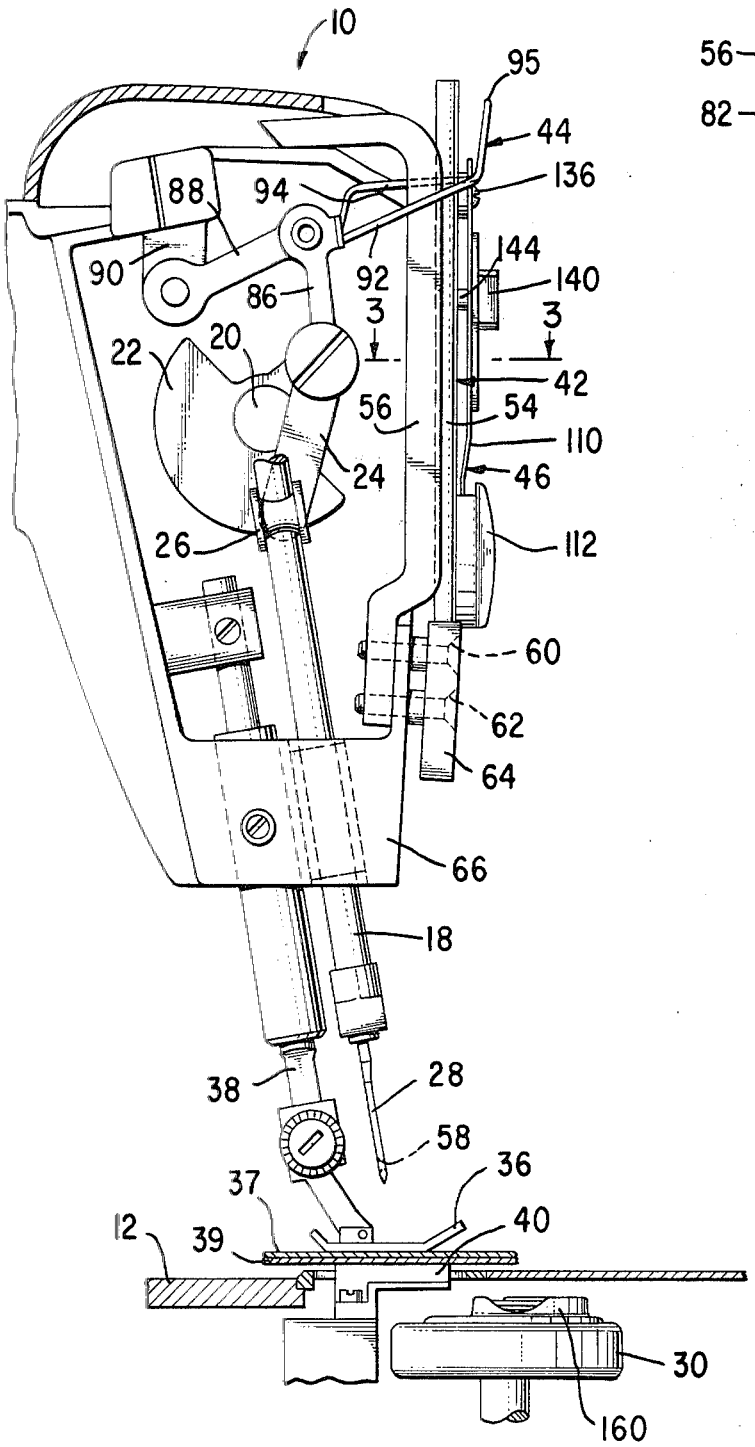
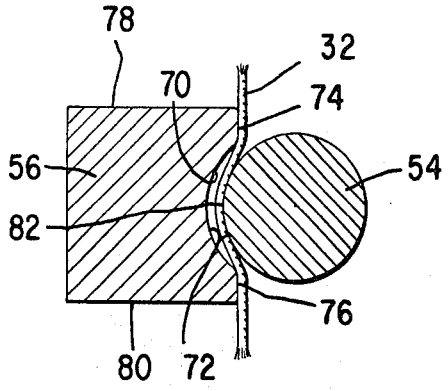
Fig. 3.
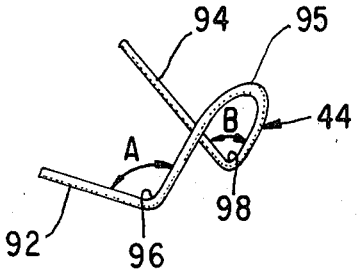
Fig. 4.

THREAD HANDLING ARRANGEMENT FOR SEWING MACHINES

DESCRIPTION

BACKGROUND OF THE INVENTION

1. Field of the Invention

The invention relates to thread handling systems for lockstitch sewing machines.

2. Description of the Prior Art

U.S. Pat. No. 4,263,859 of Ralph E. Johnson for "Thread Handling System for a Sewing Machine", issued Apr. 28, 1981, discloses a thread handling system which includes a thread holder with elongate members that grasp and meter thread to a needle and looptaker of a lock-stitch sewing machine. The system further includes a tensioning device without a check spring. Thread from a source extends to the tensioning device, and beyond the tensioning device the thread extends to the thread holder. Beyond the thread holder the thread extends to the needle. A takeup, which brackets the thread holder, sets stitches and pulls thread through the tensioning device. The takeup moves the thread in one direction in the holder to a stitch position at one end of its operating range, and moves in the opposite direction free of thread to the other end of its operating range, after which thread in the holder moves to a position of reengagement with the takeup to shorten the path for thread between the tensioning device and needle such that a quantity of thread is thereby supplied for use by the needle and looptaker. The tensioning device is disposed to one side of the elongated members of the thread holder in a position relative to the operating limits of the takeup to enable thread while the takeup is in the said other end of its operating range to be withdrawn from the tensioning device without being pulled from the thread source and with less tension in the thread than when pulled from the thread source by operation of the takeup.

SUMMARY OF THE INVENTION

The present invention is an improved version of the thread handling system of the aforesaid Johnson Pat. No. 4,263,859. In accordance with the invention, the elongate members of the thread holder are prevented from applying deleterious forces to the needle thread in the system and to take-up associated mechanism. The elongate members are fixed and are formed for frictional contact of both members with thread therebetween during movement of the thread free of the takeup. However, the take-up is both formed and disposed to cause thread in the holder to be pulled by the take-up away from one of the thread holding members during movement of the take-up in the stitch setting direction. The thread holder is thereby prevented from exerting an excessive transient force upon the thread and take-up associated mechanism during movement of the take-up in the stitch setting direction. An especially configured arm of the take-up serves to relieve undue tension in the needle thread during movement of the take-up in the thread setting direction, and the thread tensioning device of the system applies a light tensioning force to thread exiting therefrom at points within a defined exiting range.

DESCRIPTION OF THE DRAWINGS

FIG. 2 is an end elevational view of the head end portion of the machine with the end cover removed;

FIG. 3 is an enlarged sectional view taken on the plane of the line 3—3 of FIG. 2 and showing the position of thread in the thread holder of the machine during descent of the thread therein;

FIG. 4 is an enlarged perspective view of the take-up member of the machine;

DESCRIPTION OF THE PREFERRED EMBODIMENT

Figure 1:
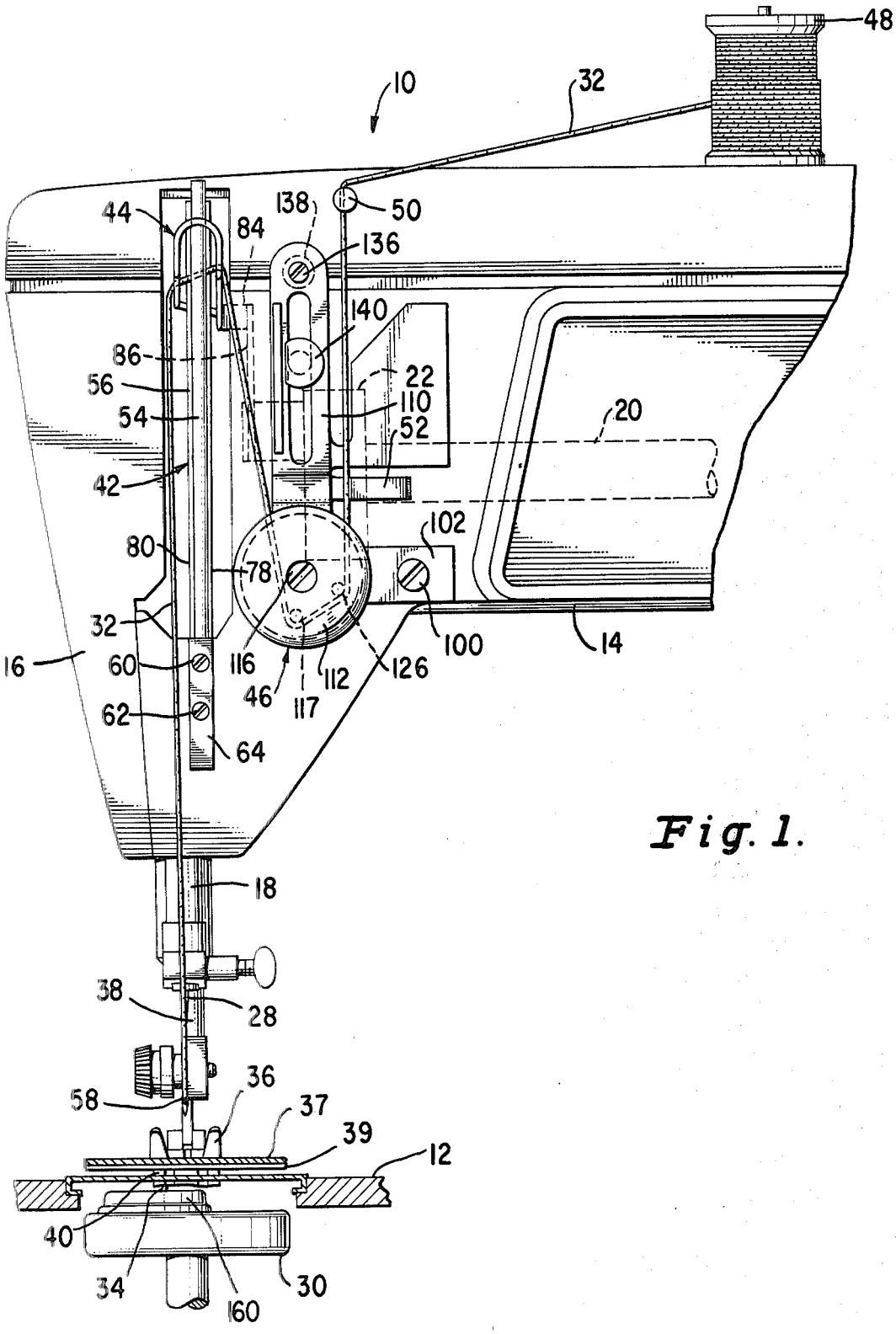
FIG. 1 is a front elevational view of a head end portion of a sewing machine including the thread handling system of the invention.
Figure 5:
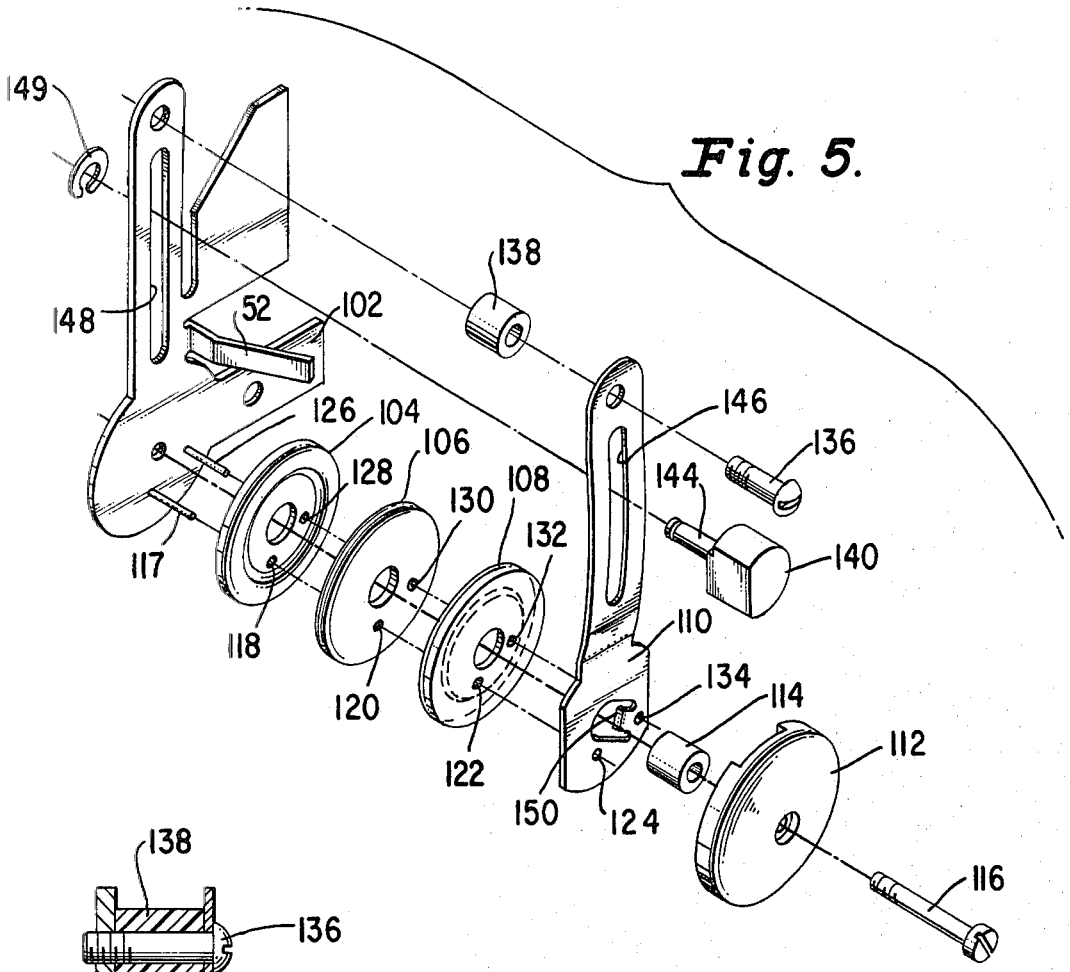
FIG. 5 is an exploded perspective view of the thread tensioning device of the machine.
Figure 6:
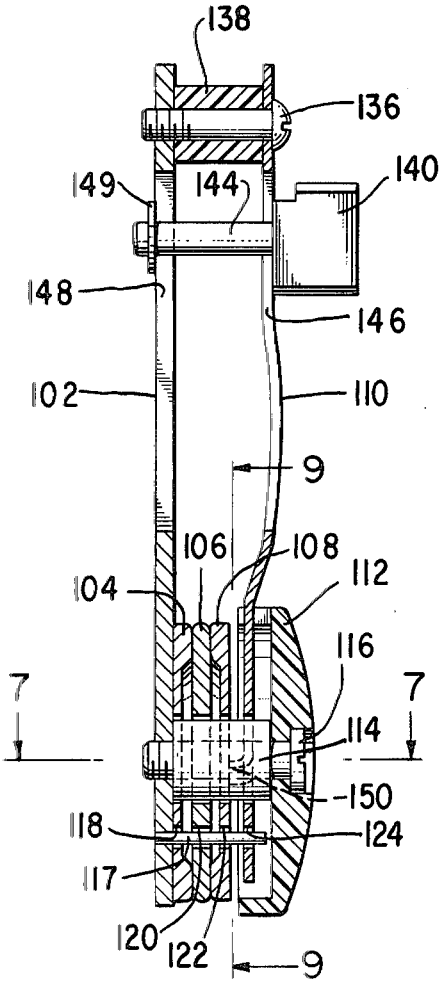
FIG. 6 is a vertical sectional view taken through the thread tensioning device.
Figure 7:
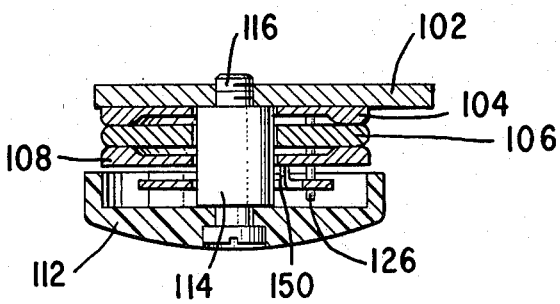
FIG. 7 is a cross-sectional view taken on the plane of the lines 7—7 of FIG. 6.

Referring to the drawings and in particular to FIGS. 1 and 2, reference character 10 designates a portin of a lock-stitch sewing machine including a work supporting bed 12, a bracket arm 14 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18 and cooperates with a rotary looptaker 30 journalled in the bed and driven in timed relationship to the arm shaft in a well known manner for concatenating needle thread 32 to form lockstitches with bobbin thread 34. A detailed description of the manner in which such lockstitches are formed may be found for example in U.S. Pat. No. 2,862,468 of R. E. Johnson for "Ornamental Stitch Sewing Machines" issued Dec. 2, 1958 and assigned to The Singer Company. A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described, for example, in U.S. Pat. No. 3,527,183 for "Work Feeding Mechanism for Sewing Machines" of The Singer Company, issued Sept. 8, 1972.

Thread 32 is supplied to the needle 28 by the thread handling system of the invention which includes a thread holder 42, a take-up member 44 and a tensioning device 46. As shown, the thread extends from a spool 48 through a thread guide 50 and past a guide 52 to tensioning device 46. The thread passes through the tensioning device and thence into the thread holder 42 where it passes between elongate members 54 and 56 of the holder and over take-up member 44 which brackets the said members 54 and 56. Beyond holder 42, the thread extends to the needle where it is threaded through the eye 58. The thread 32 is moved upwardly in the thread holder by the take-up, and is moved downwardly in the thread holder free of the take-up.

Elongate members 54 and 56 of the thread holder 42 are clamped to the front face of the sewing machine by screws 60 and 62 which extend through a base 64 integral with member 54, through a head end frame 66, and into elongate member 56. Member 54 is a cylindrical rod, and member 56 is formed with a concavity 70 to partially embrace member 54. Spacing 72 between the members 54 and 56 is such as to cause thread 32 during downward movement in the take-up to be frictionally engaged by spaced apart portions 74 and 76 of member 56 on the thread entering and thread exiting sides 78 and 80 respectively of the thread holder, and to be frictionally engaged between the spaced apart portions of member 56 by member 54 at 82 (see FIG. 3).

Take-up member 44 is affixed to a stub arm 84 extending from one end of a link 86 which has its other end pivotally connected to crank 22. A link 88 pivotally connects at one end to the link 86 as shown, and pivotally connects at the opposite end to a fixed member 90. Rotation of arm shaft 20 results in link 86 being driven by crank 22, and the link 86 guided in its motion by the link 88 imparts reciprocatory updown motion to take-up member 44 along the elongated members 54 and 56 in timed relationship to the operation of the needle 28 and looptaker 30.

As shown, the take-up 44 includes thread carrying arms 92 and 94 which extend past the thread entering and thread exiting sides respectively of the thread holder 42, and interconnect at 95 across the front of the thread holder. The arms 92 and 94 are angled to define thread carrying troughs 96 and 98 between diverging portions. As shown (see FIGS. 2 and 4), the trough defining angle A in arm 92 on the thread exiting side of the thread holder is greater than the trough defining angle B in arm 94 on the thread entering side of the holder.

Tensioning device 46 is mounted on the face of the machine by a screw 100 which engages a rigid bracket 102 of the device and extends into the sewing head 16. The tensioning device is disposed to one side of the thread holder in a position relative to the operating range of the take-up member 44 as hereinafter described.

The tensioning device includes plates 104, 106 and 108, a resilient member 110 for applying a thread tensioning force to the plates, and an end cap 112. The plates and force applying member 110 are loosely mounted upon a spacer 114 and held in an assembled relationship between bracket 102 and end cap 112 with a screw 116. The bracket 102 includes a fixed pin 117 which registers loosely in aligned holes 118, 120, 122 and 124 in plates 104, 106, 108 and member 110 respectively, and another fixed pin 126 which registers loosely in aligned holes 128, 130, 132 and 134 in the plates 104, 106, 108 and member 110.

The upper end of member 110 is secured to the upper end of bracket 102 by a screw 136 which extends through those parts and a spacer 138 therebetween. A knob 140 on the tensioning device includes a rod 144 that extends from the knob through slots 146 and 148 in the member 110 and bracket 102. A snap washer 149 on rod 144 is held against bracket 102 by spring action of member 110 on the knob 140. Downward movement of the knob results in the plates 104, 106 and 108 being moved more tightly together by a tab 150 on member 110 to increase tension on thread 32, and upward movement of the knob lessens such tension. The thread is shown in the drawings between plates 106 and 108 but it could just as well extend between plates 104 and 106, or there could be two threads, one extending between plates 104 and 106, and the other extending between plates 106 and 108 if the machine were set up to sew with a double needle.

Figure 8:
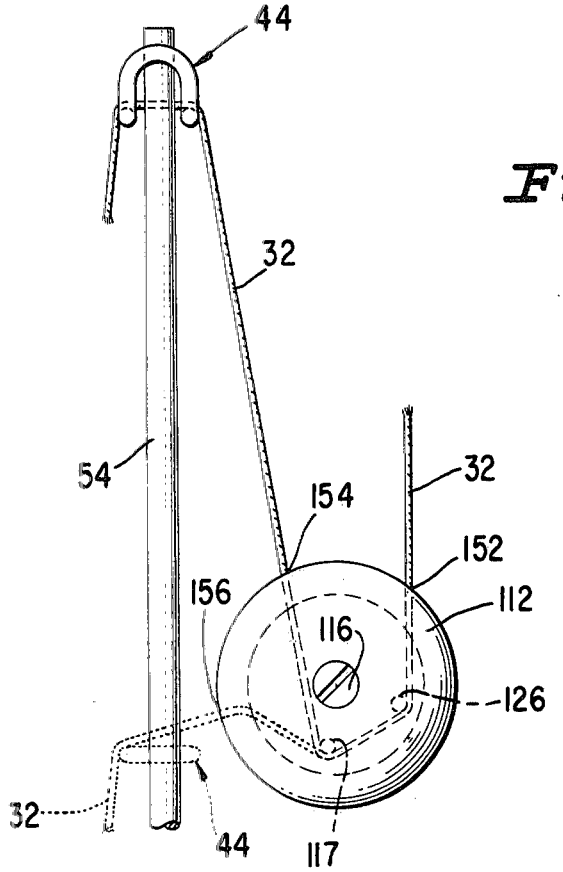
FIG. 8 is a somewhat schematic illustration showing the operative range of the take-up member relative to the tensioning device.

As shown in FIGS. 1 and 8, thread 32 extends downwardly to enter the tension device and passes around pins 126 and 117 in the lower portion of the device before exiting from the device. The thread enters the device at 152 and extends almost vertically to pin 126. Beyond pin 117 the thread extends to a variable exit point. The tensioning device is located with respect to the operating range of take-up member 44 so that thread 32 is caused to exit from the tensioning device near the upper end thereof at 154 when the take-up member 44 is at the top of its operating range (solid line position in FIG. 8), and so that when the take-up member is at the bottom of its operating range (dotted line position in FIG. 8), thread may be obtained from the tensioning device with a lowering of the exit point of thread, as for example to an extreme position at 156, or positions between 154 and 156 dependent upon the length of stitch being sewn on the machine and the thickness of material being sewn, and without thread being pulled between opposing surfaces of plates where the thread enters the device.

Figure 9:
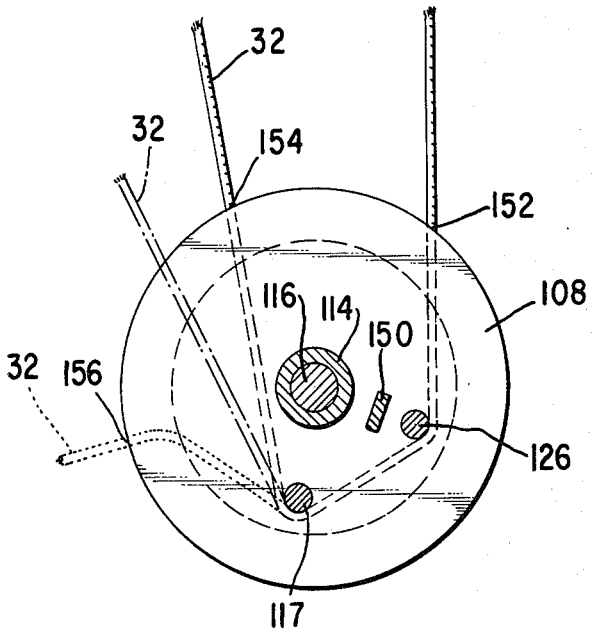
FIG. 9 is an enlarged view taken on the plane of 9—9 of FIG. 6.

Tab 150 is disposed on member 110 to engage plate 108 at a location which is inside the thread path in the tensioning device, and which is about diametrically opposite a midpoint in the possible exiting range for thread along the edge of the device between points 154 and 156 (see FIG. 9). As a consequence, a lesser force is applied to thread where it leaves the device than where it enters, and the force applied to the thread where it exits from the device remains substantially constant throughout downward movement in the tensioning at all points within the possible exiting range.

Figure 10:
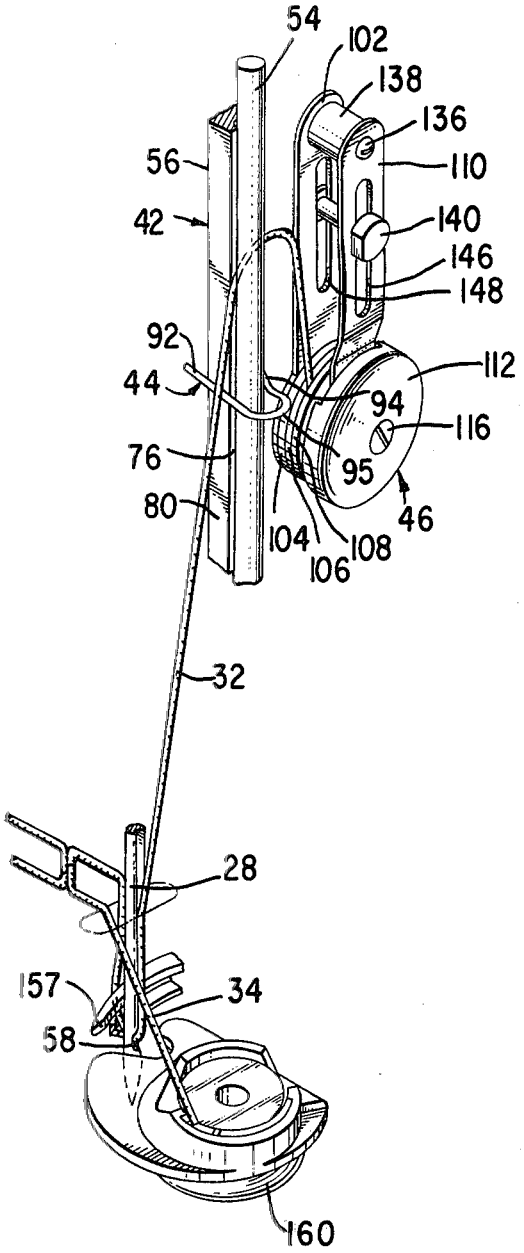
FIGS. 10, 11, 12 and 13 are diagrammatic perspective views illustrating the operation of the thread handling system.
Figure 11:
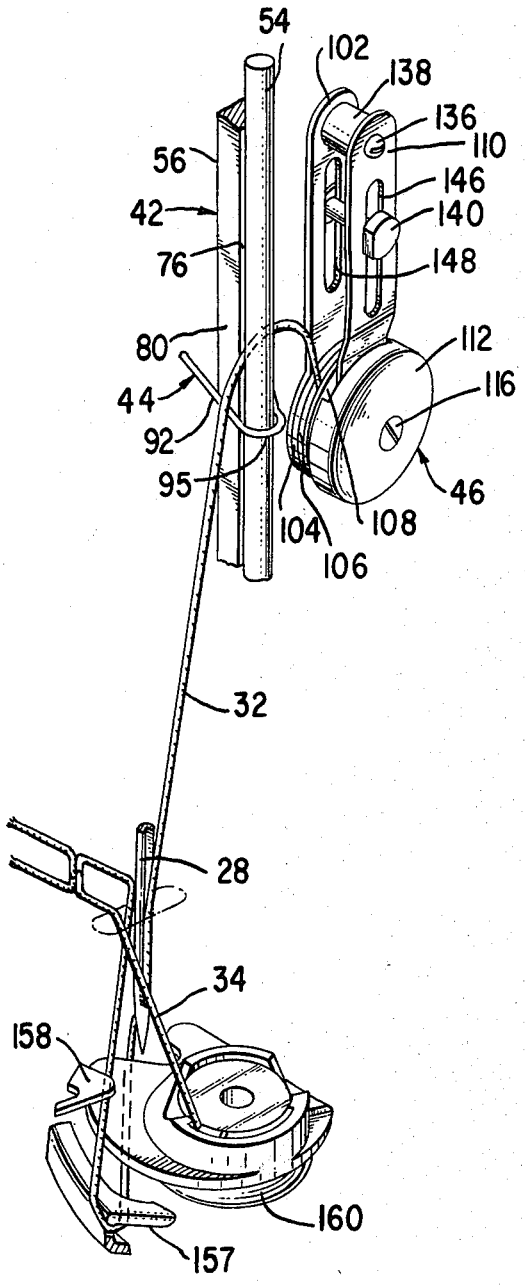

When the take-up member 44 during operation of the machine starts to move downwardly from the top of its operating range, thread 32 in the thread holder 42 is temporarily retained in its uppermost position therein between the members 54 and 56. However as the downward movement progresses, the thread is moved gradually downward in the thread holder in response to the usual demand by needle 28 and looptaker 30, and is caused to reengage the take-up member when the take-up member is at the lower end of its operating range. During the downward movement of the thread in the thread holder the thread is frictionally engaged by spaced apart portions 74 and 76 of member 56 and by the member 54 at 82. As a consequence, the thread passing to the needle and looptaker experiences tension which serves to force the thread back into the throat 157 of the looptaker (FIG. 10) and enable the looptaker to move thread under a hold down tab 158 for a bobbin case 160 without difficulty (FIG. 11).

Figure 12:
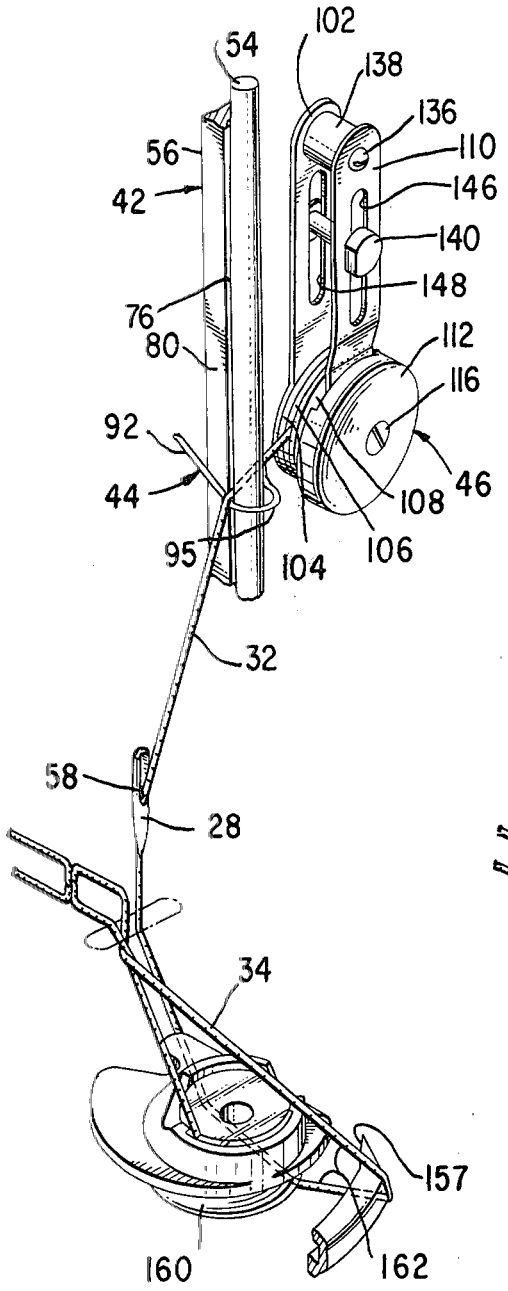

A maximum amount of thread is required by the looptaker 30 just before it reaches the position of FIG. 12 where a loop 162 is cast off the bobbin case, and any thread unavailable from the thread holder as the looptaker demand increases to the maximum is supplied from the tensioning device 46. Such thread is supplied with only light tension being exerted thereon by the tensioning device both because the thread is obtained merely by altering the exit point of thread at the tensioning device (as from 154 to 156 in FIG. 9) instead of by pulling thread through the tensioning device from the supply spool, and because the thread is thereby obtained only from a portion of the tensioning device where little force is exerted against the thread.

Figure 13:
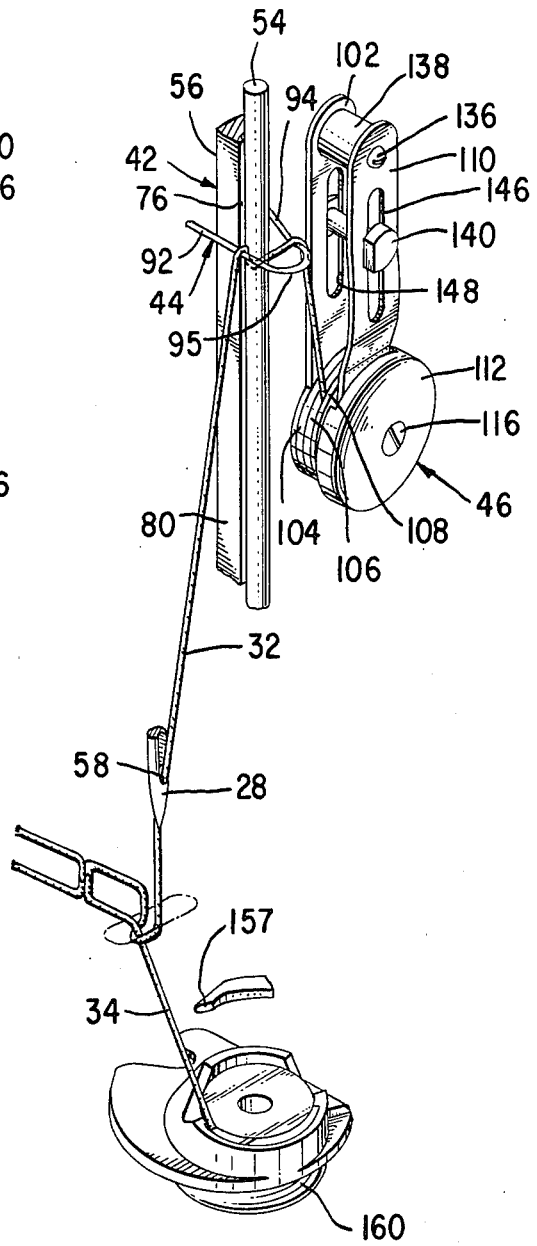
Figure 14:
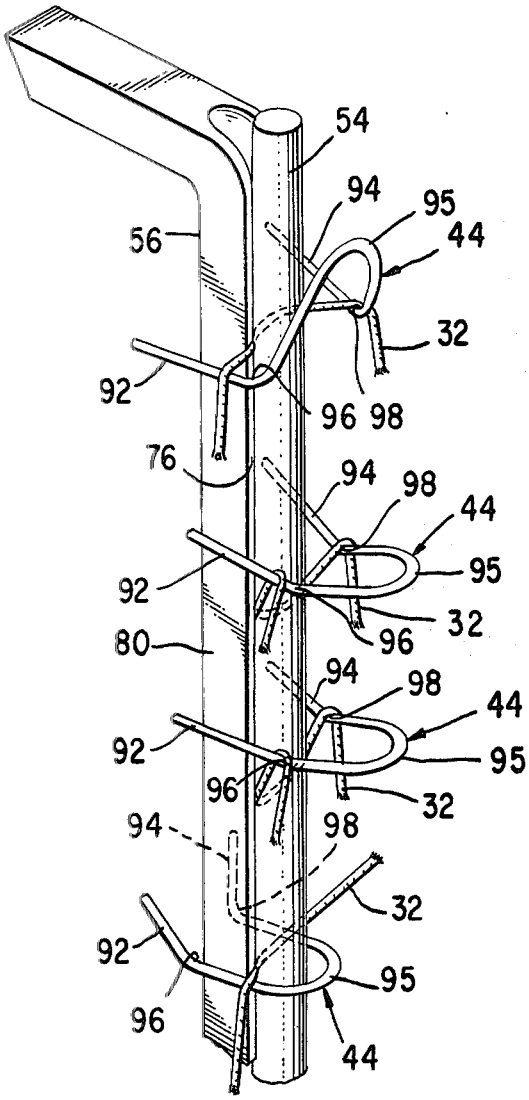
FIG. 14 is a somewhat schematic illustration indicating operative positions of the take-up member during movement in a stitch setting direction.
Figure 15:
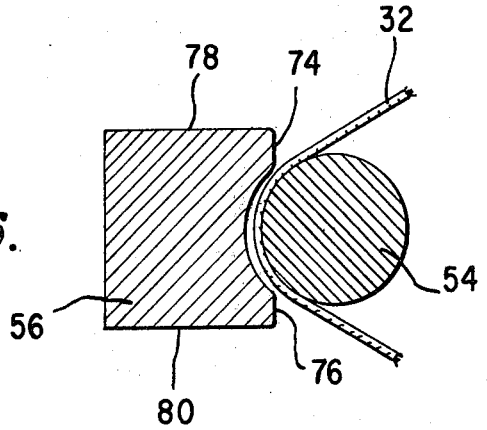
FIG. 15 is an enlarged sectional view similar to FIG. 3 showing the position of the thread in the thread holder of the machine during upward movement of the take-up member.

After cast-off, the thread is lifted by take-up member 44 in the thread holder to the temporary retention position between elongate members 54 and 56. As the thread is moved upwardly by the take-up member, the cast-off loop is closed around the bobbin thread 34 and a stitch is preset (see FIG. 13) with light tension without thread being pulled from the supply spool, after which the material is moved under the feed dog and the take-up continues to lift the thread to complete setting of the stitch with greater tension while thread is pulled from the supply spool through the tensioning device. During the upward movement of the thread in the thread holder by the take-up member (see FIG. 14), the thread is drawn by the take-up member from frictional contact with portions 74 and 76 of member 56 as shown in FIG. 3 to a position (FIG. 15) wherein the thread is out of contact with member 56, and drag on the thread by the thread holder is thereby reduced. Such reduction in drag has the beneficial effect of reducing the downward force on the take-up member by thread 32, and reaction forces within the mechanism driving the take-up member. The reduction in drag also assists in the presetting of a stitch with light tension in the thread. As noted hereinbefore, there is a difference in the trough defining angles A and B in arms 92 and 94 respectively of the take-up member. The lesser angle A permits thread 32 to walk up arm 92 when the thread is being rapidly accelerated upwardly by the take-up and to relieve tension in the thread tending to occur as a result.

It is to be understood that the present disclosure relates to preferred embodiments of the invention which are for purposes of illustration only and are not to be construed as a limitation of the invention. Numerous alterations and modifications may be made to the structures shown and described without departing from the spirit and scope of the invention as defined in the annexed claims. For example, while the thread holder has been shown with members 54 and 56 extending parallel to each other and with constant spacing therebetween over the distance through which the thread 32 is movable along said members, the thread holder may be modified to increase the distance between the members beyond a selected point in the downward descent of the thread in the thread holder to eliminate frictional drag on the descending thread of the thread holder where not required.

I claim:

1. In a sewing machine wherein a sewing needle and looptaker cooperate in the formation of lock stitches in a fabric, the combination comprising:

a thread source;

a thread tensioning device to which thread extends from the thread source;

a thread holder to which thread extends from the tensioning device and from which thread extends to the needle; and a takeup for setting stitches and pulling thread through the tensioning device from the thread source, the takeup being movable in a stitch setting direction with thread to one end of its operating range whereat the thread is positioned for temporary retention in the holder and movable in the opposite direction free of the thread holder to the other end of said operating range to permit thread to move in the holder from the temporary retention position to a position of reengagement with the takeup at said other end of its operating range whereby the path for thread between the tensioning device and needle is shortened, and a quantity of thread is supplied for use by the needle and looptaker; said thread holder including a pair of fixed elongate thread holding members which extend parallel to one another for at least a portion of their lengths and are spaced apart to receive the thread from the tensioning device therebetween, the elongate thread holding members being formed for frictional contact of both members with the thread at spaced locations only on one member and at a location therebetween on the other member during movement in the holder in said opposite direction free of the takeup, the takeup being formed and being disposed relative to the thread holder to cause thread in the thread holder to be pulled out of contact with the said one member at the spaced apart thread contacting locations by the takeup and frictional drag on the thread to be thereby reduced in the thread holder during movement of the takeup in the stitch setting direction.

2. The combination of claim 1 wherein one of the thread handling members is a cylindrical rod and the other thread handling member is formed to partially embrace the cylindrical rod.

3. The combination of claim 1 wherein the takeup includes a pair of thread carrying arms one of which extends to the thread entering side of the thread holder and the other of which extends to the thread exiting side of the holder, each of the arms being angled to define a thread catching trough between diverging portions thereof and the arm on the thread exiting side of the holder being angled to a greater degree than the other to permit thread to slide on the greater angled side out of the trough therein and thereby relieve thread tension.

4. The combination of claim 1 wherein the takeup includes a pair of thread carrying arms which interconnect across the front of the holder, one of said arms extending therefrom on one side of the thread holder and the other arm extending on the other side of the thread holder, each of the arms being angled to define a thread catching trough between diverging portions thereof and the arm on the thread exiting side of the holder being angled to a greater degree than the other to permit thread to slide on the greater angled arm out of the trough therein and thereby relieve excessive thread tension.

5. The combination of claim 1 wherein the thread tensioning device is disposed on one side of the elongate members of the thread holder in a position relative to ends of the operating range of the takeup to enable thread while the takeup is in the said other end of its operating range to be obtained from the device with movement of the exiting point of the thread on the device along an edge thereby without the thread being pulled from the thread source and with less tension than when pulled from the thread source by operation of the takeup, said tensioning device including a pair of thread engageable plates and means substantially diametrically opposite a midpoint in a defined range of movement of said thread exiting point for applying a thread tensioning force to the plates.

6. The combination of claim 5 wherein thread is led downwardly into the tensioning device and thread leaving the tensioning device is caused to extend upwardly when the take-up is in the said one end of its operating range.

7. The combination of claim 6 wherein the tensioning device includes thread guiding pins in the bottom portion thereof.

8. The combination of claim 7 wherein the force applying means is located inside possible thread paths through the tensioning device.

* * * * *